US007431559B2

(12) United States Patent
Paauwe et al.

(10) Patent No.: US 7,431,559 B2
(45) Date of Patent: Oct. 7, 2008

(54) DIRT SEPARATION FOR IMPINGEMENT COOLED TURBINE COMPONENTS

(75) Inventors: Corneil Paauwe, Manchester, CT (US); Joseph Bridges, Durham, CT (US); Matthew Devore, Portland, CT (US)

(73) Assignee: United Technologies Corporation, Hartford, CT (US)

( * ) Notice: Subject to any disclaimer, the term of this patent is extended or adjusted under 35 U.S.C. 154(b) by 38 days.

(21) Appl. No.: 11/018,629

(22) Filed: Dec. 21, 2004

(65) Prior Publication Data

US 2006/0133923 A1 Jun. 22, 2006

(51) Int. Cl.
*F01D 5/14* (2006.01)

(52) U.S. Cl. ..... 415/115; 415/121.2; 415/116

(58) Field of Classification Search ..... 415/115, 415/116, 121.2; 416/96 R, 97 R, 97 A
See application file for complete search history.

(56) References Cited

U.S. PATENT DOCUMENTS

| | | | | |
|---|---|---|---|---|
| 3,574,481 | A * | 4/1971 | Pyne et al. | 416/90 R |
| 4,252,501 | A * | 2/1981 | Peill | 415/115 |
| 4,685,942 | A | 8/1987 | Klassen et al. | |
| 5,419,039 | A * | 5/1995 | Auxier et al. | 29/889.721 |
| 6,652,220 | B2 | 11/2003 | Powis | |
| 6,698,180 | B2 * | 3/2004 | Snyder | 60/39.092 |
| 2005/0220626 | A1 * | 10/2005 | Gray | 416/232 |

FOREIGN PATENT DOCUMENTS

| | | |
|---|---|---|
| EP | 1247940 A1 | 10/2002 |
| GB | 1467483 A | 3/1977 |
| JP | 2233801 | 9/1990 |
| JP | 2004144084 | 5/2004 |

OTHER PUBLICATIONS

Australian Search Report, dated Jun. 30, 2006.
Japanese Office Action dated Mar. 13, 2008.

* cited by examiner

*Primary Examiner*—Hoang Nguyen
(74) *Attorney, Agent, or Firm*—Carlson, Gaskey & Olds

(57) ABSTRACT

A vane for use in a gas turbine engine has a leading edge facing an upstream combustor. The vane has hollow areas that receive an impingement tube for delivering impingement air. The impingement tube includes a radially outer portion and a radially inner portion. An end wall of the radially outer portion is angled relative to a rotational axis of the turbine such that air entering the impingement tube from a radially outer source has dirt directed away from the leading edge. Thus, dirt is less likely to clog leading edge air supply holes. In one embodiment, the inner and outer portions are formed as separate pieces, and in another embodiment, the inner and outer portions are formed as a single piece.

21 Claims, 3 Drawing Sheets

DIRT SEPARATION FOR IMPINGEMENT COOLED TURBINE COMPONENTS

This invention was made with government support under Contract No.: N00019-02-C-3003 awarded by the United States Navy. The government therefore has certain rights in this invention.

BACKGROUND OF THE INVENTION

This invention relates to an impingement tube received within a turbine component, and in which the impingement tube has an inner and outer portion, with the outer portion being configured to minimize dirt blockage of impingement air at the leading edge. In one embodiment, the inner and outer portions are formed as separate pieces, and in another embodiment, the inner and outer portions are formed as a single piece.

Turbine engines have a number of components. One type of component is a stationary vane. The vanes are in the path of hot air downstream of a combustor, and have a leading edge that faces the hot air. The vane is thus exposed to high temperatures and requires cooling. One method utilized to cool the vane, is to form the vane to have hollow areas, and place impingement tubes within the hollow areas. The impingement tubes have a number of holes for directing impingement air outwardly to points within the vane. Holes also extend through the wall of the vane in order to direct the impingement air onto an outer surface of the vane.

This application relates to an impingement tube used within the hollow area of the vane that receives cooling air from both inner and outer vane cooling air supplies. One known way of supplying impingement cooling air from both inner and outer supplies is to use an impingement tube which includes an outer portion and an inner portion. Each of the inner and outer portions have an end wall roughly at an intermediate position within the vane, and with end walls both being generally parallel to an axis of rotation for the turbine. Outer cooling air is brought within the outer portion and inner cooling air is brought within the inner portion. The holes within the impingement tube portions and the vane are concentrated adjacent the leading edge of the vane.

It has been found that the air from a radially outer source carries more dirt than air from a radially inner source. The holes in the impingement tube and vane are relatively small, and are sometimes clogged by dirt within the impingement airflow. When this dirt clogs the holes near the leading edge, less air than may be desirable is directed to the leading edge.

SUMMARY OF THE INVENTION

In a disclosed embodiment of this invention, a vane receives an impingement tube including an inner and an outer portion. In one embodiment, end walls of the inner and outer portions are formed to be non-parallel relative to the axis of rotation of the turbine. In particular, an end wall within the outer portion is positioned such that the outer portion covers less of a leading edge of the vane than it covers at the aft end spaced towards the trailing edge. In the disclosed embodiment, the end wall of the outer portion is generally planar, and angled radially inwardly from the leading edge moving toward trailing edge. In this manner, the outer portion has more surface area adjacent the aft end than it does at the leading edge. Thus, the dirtier outer impingement air flows in greater volumes to the aft end than it does to the leading edge.

The inner portion is formed in an opposite manner, with its end wall also moving radially inwardly from the leading edge toward the trailing edge. However, with the inner portion, the effect of this angled end wall is to increase the volume of air directed from the inner impingement air source to the leading edge relative to the volume of air directed to the aft end.

Not only does this shape reduce the volume of outer impingement airflow being directed to the leading edge relative to the aft end, but there are also mechanical means and resultant flow dynamics that reduce the amount of dirt reaching the leading edge of the vane. In particular, when air from the outer impingement air source enters the outer portion, there is momentum which causes dirt to be directed along the angled end wall away from the leading edge and toward the aft end of the outer impingement tube. With the prior art construction, dirt was not directed toward the aft end and was as likely to initially reside at the leading edge as it was the aft end. Also, with the prior art construction, dirt initially at the aft end can migrate back toward the leading edge. However, with the present invention, the angled end wall "pins" the dirt at the aft end. This is due to a pressure loading from the wedge shape. Purge holes at the bottom of the wedge, in conjunction with the suppressed static pressure inherent to the decrease in area heading toward the aft edge, create an increased dynamic pressure load that resists movement of the dirt from the aft end toward the leading edge in the outer portion. Also, the angled end wall creates a wedge shape which acts as a mechanical means of trapping the dirt. The angled end wall first directs dirt to the aft end of the outer impingement tube where once there its is pinned both mechanically and from the resulting flow dynamics from movement toward the leading edge.

The dirt thus tends to become trapped or to exit the outer portion adjacent the aft end. The dirt that exits the outer portion adjacent the trailing edge may then leave the vane altogether through film holes in the outer surface of the vane adjacent the aft end. In essence, the wedge shape creates a trap that either captures dirt permanently or allows the dirt to exit the vane adjacent the aft end where it is least likely of plugging the leading edge of the vane.

While the invention is disclosed with generally planar end walls angled in this fashion, other shapes for the outer portion and/or the inner portion could be utilized, as long as they achieve the goal of reducing the airflow from the outer impingement air source to the leading edge of the vane.

In a first embodiment, the inner and outer portions are formed as separate pieces. In a second embodiment, the inner and outer portions are formed as a single piece.

The present invention thus reduces the likelihood of the dirt within the outer airflow from reducing the impingement airflow to the leading edge of the vane.

These and other features of the present invention can be best understood from the following specification and drawings, the following of which is a brief description.

DETAILED DESCRIPTION OF THE PREFERRED EMBODIMENT

Figure 1:
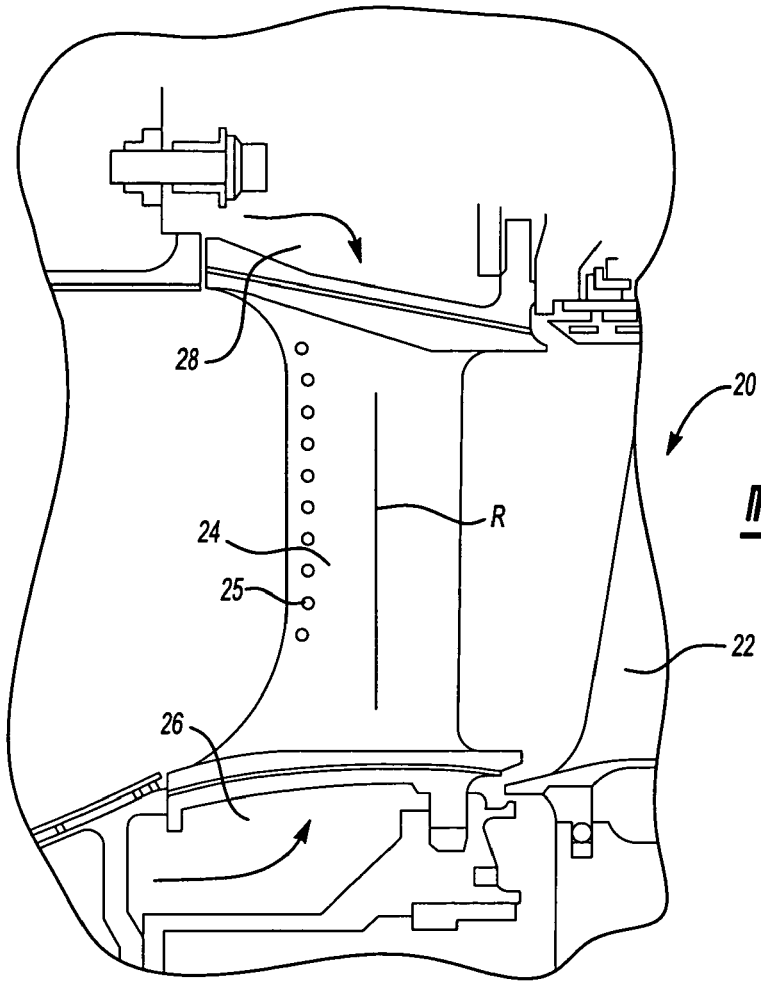
FIG. 1 is a view of a portion of a turbine engine.

A gas turbine engine 20 is illustrated in FIG. 1. As is known, rotor blades 22 rotate about a central axis, and receive air from an upstream combustor. A plurality of stationary vanes 24 are positioned adjacent the rotor blades 22. As is known, the vanes 24 are exposed to very hot air, and thus cooling air is directed into the vanes 24. As shown, there is a radially inner source 26 for cooling air and a radially outer source 28 for cooling air. The air exits the vanes 24 such as through film cooling holes 25 found at the leading edge. Other holes are found across the vane, but are not illustrated for simplicity. It has been determined that the radially outer source 28 directs air that carries more dirt into the vane 24 compared to the radially inner source 26. A radial line R, which will be used as a reference below, could be described which is generally perpendicular to the rotational axis of the rotor blades 22.

Figure 2A:
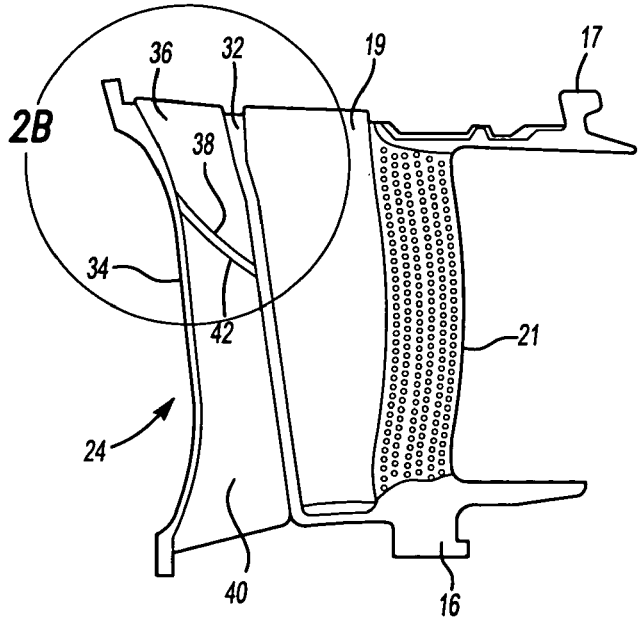
FIG. 2A shows a vane incorporating the present invention.

FIG. 2A shows vane 24, having a leading edge 34, a rib 32 spaced toward a trailing edge 21, as well as inner and outer platforms 16 and 17, respectively. As shown, a hollow area 19 will receive one impingement tube, and another impingement tube is received in another hollow area and includes an outer portion 36 and an inner portion 40 adjacent the leading edge 34. As shown, the outer portion 36 has an end 38 and the inner portion 40 has an end 42.

Figure 2B:
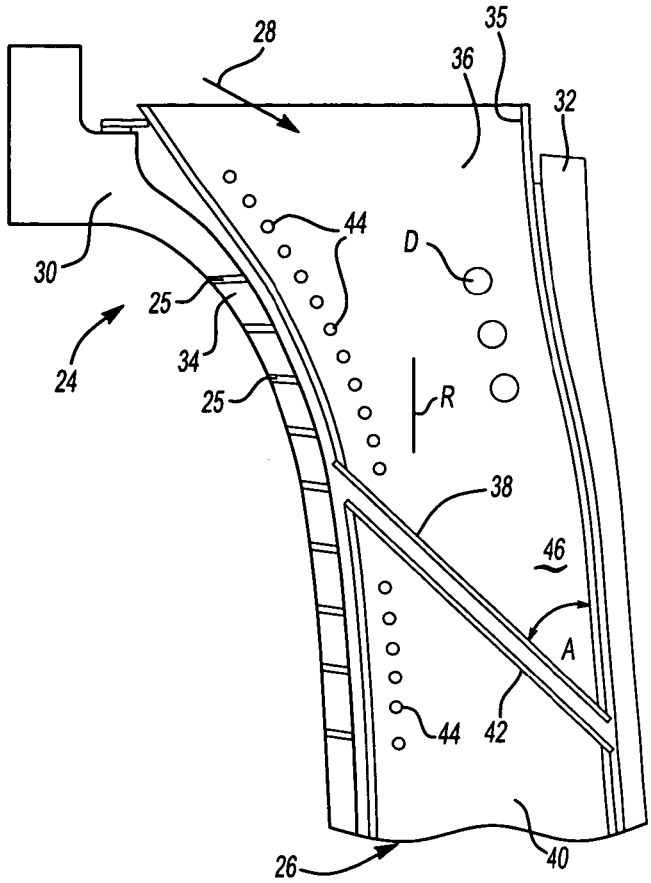
FIG. 2B is a cross-sectional view through a portion of a vane.

As shown in FIG. 2B, vane 24 includes an outer wall 30 at a leading edge 34. As known, the leading edge 34 is exposed to the hottest temperatures, as it directly faces into the flow downstream of the combustor.

The cooling air from the outer air source 28 is directed into the outer impingement tube portion 36 having an end wall 38. The inner impingement tube portion 40 receives air from the inner air source 26, and has an end wall 42. As can be appreciated from FIGS. 2A and 2B, the end walls 38 and 42 are not perpendicular to the radius R, or stated otherwise, are not parallel to the rotational axis of the rotor blade 22. In the prior art, the end walls 38 and 42 have been parallel to the rotational axis of the rotor blade 22.

The impingement tube portions 36 and 40 include a number of impingement airflow holes 44. The holes 44 are found across the impingement air tube portions 36 and 40, however, they are only illustrated adjacent the leading edge 34 in this application. The impingement air tube portions have a greater concentration of holes 44 adjacent the leading edge, as it is desirable to direct the most cooling air to the leading edge. However, it should be understood that other holes would be found spaced away from the leading edge of the impingement tube portions 36 and 40. These holes are simply not illustrated in these figures for simplicity of illustration.

As mentioned above, dirt D is found to a greater extent in the outer airflow source 28 than in the inner airflow source 26. In the past, this dirt has plugged holes such as holes 44 and 25. This is especially detrimental at the leading edge 34.

Momentum from the outer airflow 28 will carry the heavier dirt particles D into the wedge created between the aft end 35 and the end wall 38 and further away from the leading of the outer impingement tube holes 44 and leading edge holes 25. In the prior art, with the end wall being parallel to the rotational axis of the turbine, the dirt particles were not directed away from the leading edge or restrained from migrating back toward the leading edge and eventually plugging the holes 25 and 44 adjacent the leading edge 34.

The present invention addresses this concern in three ways. First, since the end wall 38 is angled from the leading edge inward toward the aft end 35, there is a dynamic pressure load on the dirt particles D resisting migration toward the leading edge. Second, due to the wedge shape created between aft end 35 and end wall 38 dirt will become trapped within the deep tight corner of the impingement tube or exit the aft end 35 instead of migrating toward the leading edge and plugging holes 25 and 44. Further, the simple geometry of the outer impingement tube portion 36 is such that there is less flow cross-sectional area adjacent the leading edge than there is adjacent the aft end edge. As can be appreciated from FIG. 2, the opposite would be true of the radially inner impingement tube portion 40. Thus, the radially inner source 26 provides a greater volume of cooling air to the leading edge 34 than it does to the second end 35, while the radially outer source 28 supplies more impingement cooling air to the aft end 35 than it does the leading edge 34. These factors in combination, reduce the amount of dirt likely to reach the holes 25 and 44 in the leading edge of the vane 24 and the outer impingement tube portion 36.

An angle A measured between the end wall 38 and the aft end 35 of the outer impingement tube portion 36 is preferably between 20 and 60°. In one embodiment, the angle is 36°. It is important that the angle is small enough to collect the dirt, but not large enough to affect the cooling airflow through the impingement tube. The angle of the inner portion end 42 wall is parallel to end wall 38.

Thus, the problem discussed above is addressed. There is a greater reliability of impingement air being directed to the leading edge 34 of the vane 24.

Figure 3:
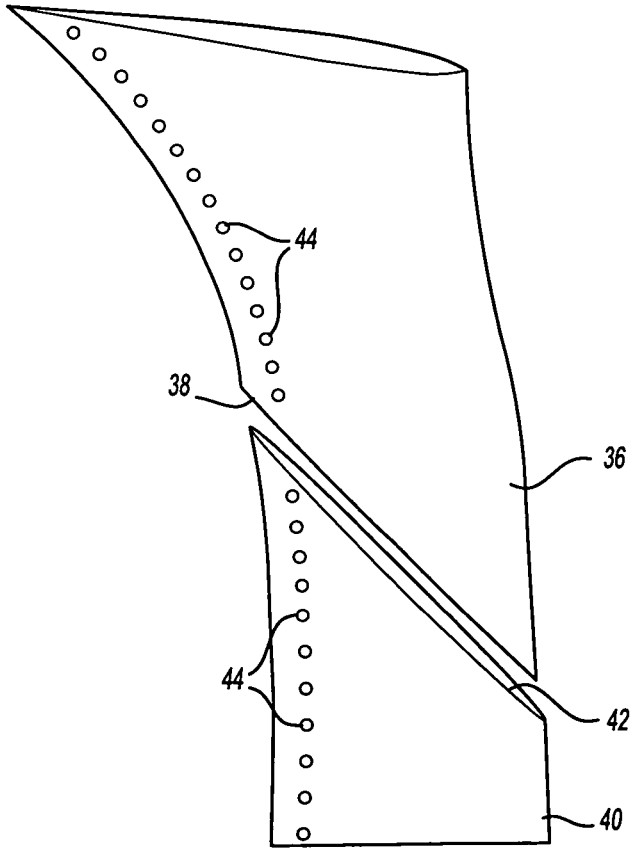
FIG. 3 is a perspective view of an inventive impingement tube set.

FIG. 3 shows further detail of the impingement tubes 36 and 40.

While in the disclosed embodiment the end walls 38 and 42 are generally planar, other shapes for the impingement tube portions that would achieve the volume flow characteristics described above, and/or the resistance to dirt migration would come within the scope of this invention.

Figure 4:
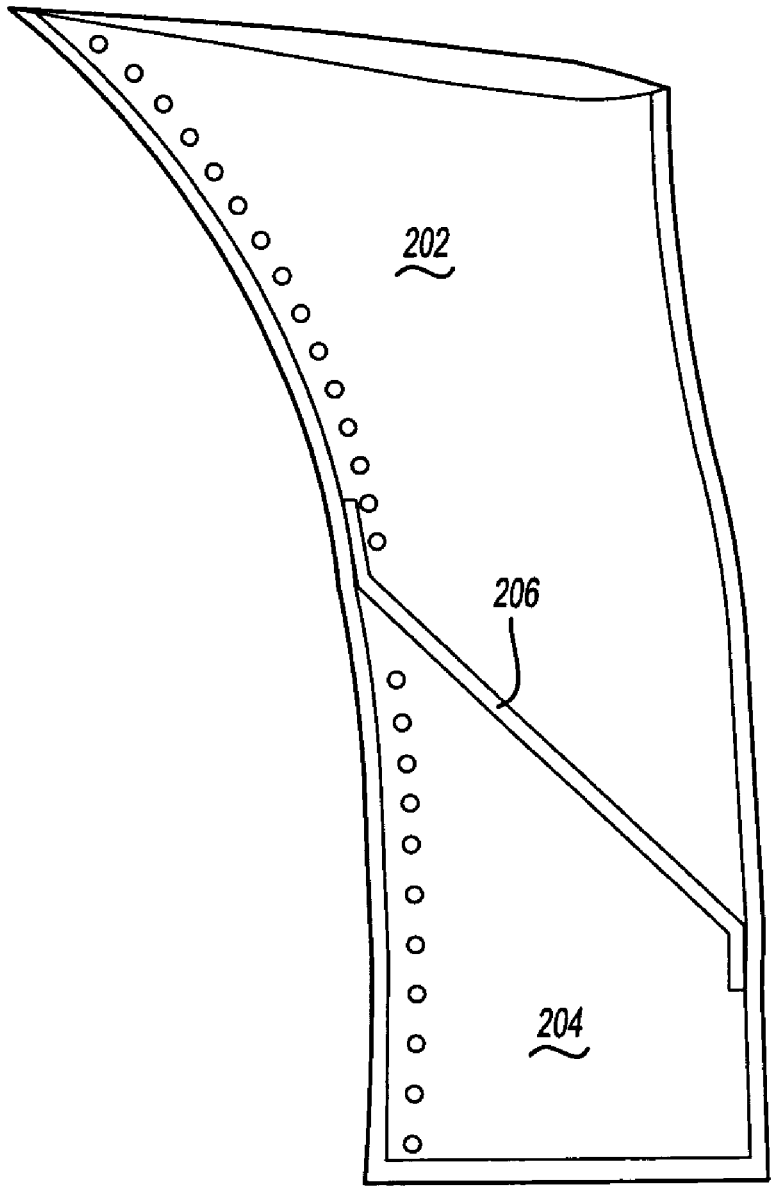
FIG. 4 shows a second embodiment impingement tube.

In the above embodiments, the inner and outer portions are formed as separate pieces. FIG. 4 shows an embodiment wherein the outer portion 202 and inner portion 204 of an impingement tube are formed as a single piece. A single wall 206 provides the characteristics as mentioned above.

While the invention is disclosed in a vane, it would have potential application in other turbine components that receive both inner and outer cooling air flows. Examples may include burner liners, flame holders, turbine exhaust cases, etc.

Although a preferred embodiment of this invention has been disclosed, a worker of ordinary skill in this art would recognize that certain modifications would come within the scope of this invention. For that reason, the following claims should be studied to determine the true scope and content of this invention.

What is claimed is:

1. A gas turbine engine comprising:

at least one rotor for rotating about a central axis;

at least one vane, said vane having a leading edge and a trailing edge, said vane receiving an impingement tube adjacent said leading edge, said impingement tube having a leading edge and an aft end spaced from said leading edge and towards said trailing edge of said vane;

an outer air source for directing air from a radially outer location into said impingement tube, and an inner air source for directing air from a radially inner location into said impingement tube; and said impingement tube including a radially outer portion and a radially inner portion, with said radially inner portion receiving air from said inner air source and said radially outer portion receiving air from said outer air source, said radially inner and outer portions having impingement air holes for directing impingement air to a position adjacent said leading edge of said vane, and at least said radially outer portion being configured to direct a greater volume of impingement air toward said aft end of said vane than the volume directed toward said leading edge.

2. The gas turbine engine as set forth in claim 1, wherein said radially inner portion directs a greater volume of impingement airflow toward said leading edge of said vane than it does toward said aft end.

3. The gas turbine engine as set forth in claim 2, wherein both said radially outer and radially inner portions have end walls.

4. The gas turbine engine as set forth in claim 3, wherein said end wall of said radially outer portion being angled from said leading edge toward said aft end in a radially inner direction such that a leading edge of said radially outer portion is shorter than said aft end.

5. The gas turbine engine as set forth in claim 4, wherein said end wall of said radially inner portion being angled from said leading edge toward said aft end in a radially inner direction such that a leading edge of said radially inner portion is longer than a aft end.

6. The gas turbine engine as set forth in claim 5, wherein said end walls of said radially outer portion and said radially inner portion are generally parallel to each other.

7. The gas turbine engine as set forth in claim 4, wherein an angle between said end wall and said aft end of said radially outer portion is between 20° and 60°.

8. The gas turbine engine as set forth in claim 1, wherein said radially outer portion and said radially inner portion are formed as separate pieces.

9. The gas turbine engine as set forth in claim 1, wherein said radially outer portion and said radially inner portion are formed as a single piece.

10. A turbine component comprising:

a body having a leading edge and a trailing edge, said body having a radially outer edge and a radially inner edge;

an impingement tube receiving within said body and including a radially outer portion and a radially inner portion, with said radially inner portion for receiving air from a radially inner source and said radially outer portion for receiving air from a radially outer source, said radially inner and outer portions having impingement air holes for directing impingement air to a position adjacent said leading edge of said body, and at least said radially outer portion being configured to direct a greater volume of impingement air to a aft end, spaced from said leading edge and in a direction toward said trailing edge of said body, than is directed toward said leading edge.

11. The turbine component as set forth in claim 10, wherein said body is a vane airfoil.

12. The turbine component as set forth in claim 11, wherein said radially inner portion directs a greater volume of impingement airflow toward said leading edge of said vane than it does toward said aft end.

13. The turbine component as set forth in claim 12, wherein both said radially outer and radially inner portions have end walls.

14. The turbine component as set forth in claim 13, wherein said end wall of said radially outer portion being angled from said leading edge toward said aft end in a radially inner direction such that said leading edge of said radially outer portion is shorter than said second end.

15. The turbine component as set forth in claim 14, wherein said end wall of said radially inner portion being angled from said leading edge toward said aft end in a radially inner direction such that said leading edge of said radially inner portion is longer than said aft end.

16. The turbine component as set forth in claim 15, wherein said end walls of said radially outer portion and said radially inner portion are generally parallel to each other.

17. The turbine component as set forth in claim 14, wherein an angle between said end wall and said second end of said radially outer portion is between 20° and 60°.

18. The turbine component as set forth in claim 10, wherein said radially outer portion and said radially inner portion are formed as two separate pieces.

19. The turbine component as set forth in claim 10, wherein said radially outer portion and said radially inner portion are formed as a single piece.

20. A method of reducing dirt flow toward a leading edge of a hollow airfoil comprising the steps of:

(1) providing a airfoil, and an impingement tube within said airfoil, with a radially outer impingement tube portion and a radially inner impingement tube portion, directing a radially outer air source into said radially outer impingement tube portion, and directing a radially inner source into said radially inner impingement tube portion;

(2) shaping said outer impingement tube portion such that it minimizes dirt moving toward a leading edge of said radially outer impingement tube portion; and (3) directing air from said radially inner impingement tube portion and said radially outer impingement tube portion through impingement air holes toward a leading edge of said airfoil.

21. The method as set forth in claim 20, wherein an end wall of said radially outer impingement tube portion is shaped such that a greater volume of airflow is directed from said radially outer source to a aft end of said radially outer impingement tube portion that is spaced toward a trailing edge of said air foil, than is directed to said leading edge.

* * * * *